US005646663A

United States Patent [19]

Clark et al.

[11] Patent Number: 5,646,663

[45] Date of Patent: Jul. 8, 1997

[54] METHOD AND APPARATUS FOR CONTINUOUS INK JET PRINTING WITH A NON-SINUSOIDAL DRIVING WAVEFORM

[75] Inventors: James E. Clark, Naperville; Mairi C. MacLean, South Elgin; Jianming Tsai, Schaumburg, all of Ill.

[73] Assignee: Videojet Systems International, Inc., Wood Dale, Ill.

[21] Appl. No.: 307,193

[22] Filed: Sep. 16, 1994

[51] Int. Cl.[6] ..... B41J 2/02; B41J 2/07

[52] U.S. Cl. ..... 347/75; 347/73; 347/74

[58] Field of Search ..... 347/75, 74, 73

[56] References Cited

U.S. PATENT DOCUMENTS

| | | | |
|---|---|---|---|
| 3,683,396 | 8/1972 | Keur et al. . | |
| 3,715,219 | 2/1973 | Kurz et al. . | |
| 3,928,855 | 12/1975 | Helinski et al. | 346/1 |
| 3,935,783 | 2/1976 | Machanian et al. | 84/1.21 |
| 3,972,474 | 8/1976 | Keur . | |
| 3,979,756 | 9/1976 | Helinski . | |
| 4,056,741 | 11/1977 | Hoerz et al. | 310/322 |
| 4,160,971 | 7/1979 | James et al. | 340/152 T |
| 4,417,255 | 11/1983 | Furukawa . | |
| 4,419,673 | 12/1983 | Ebi et al. . | |
| 4,897,665 | 1/1990 | Aoki . | |
| 5,146,236 | 9/1992 | Hirata et al. . | |
| 5,206,944 | 4/1993 | Pilkentun | 395/425 |
| 5,276,468 | 1/1994 | Deur et al. | 346/140 |

FOREIGN PATENT DOCUMENTS

| | | |
|---|---|---|
| 2322744 | of 1976 | France . |
| 1544493 | 4/1979 | United Kingdom . |

OTHER PUBLICATIONS

Curry et al., "Scale Model of an Ink Jet", *IBM J. Research Development*, 10–20 (Jan. 1977).

Iversen, "Liquid Solder Jetting Attracts U.S. Research", *Assembly*, 27–30 (Mar. 1994).

Rezanka et al., "Satellite Control by Direct Harmonic Excitation", *Journal of Imaging Technology*, 16, No. 1, 43–47 (Feb. 1990).

Patent Abstracts of Japan vol. 006 No. 023 (M–111), 10 Feb. 1982 & JP, A, 56 139973 (Sharp Corp.) 31 Oct. 1981.

Patent Abstracts of Japan vol. 003 No. 156 (E–161), 21 Dec. 1979 & JP,A54 137320 (Matsushita Electric Ind. Co Ltd) 25 Oct. 1979.

Patent Abstracts of Japan vol. 006 No. 138 (M–145), 27 Jul. 1982 & JP,A,57 059766 (Sharp Corp) 10 Apr. 1982.

Patent Abstracts of Japan vol. 007 No. 079 (M–204), 31 Mar. 1983 & JP,A,58 005272 (Epuson KK;Others:01) 12 Jan. 1983.

*Primary Examiner*—Mark J. Reinhart
*Assistant Examiner*—Raquel Yuetle Gordon
*Attorney, Agent, or Firm*—Leydig, Voit & Mayer, Ltd.

[57] ABSTRACT

An apparatus and method for producing a stream of ink drops in a continuous ink jet printer having a maximum allowable number of fast satellite drops. An ink, which may be a hot-melt ink in its liquid phase, is pressurized for continuous flow to a nozzle and a rectangular or triangular waveform is generated at a fixed frequency. The waveform is applied to a transducer coupled to the nozzle such that nozzle vibrates and the ink flow is perturbed and discharged from the nozzle as primary drops with satellite drops formed therewith. The harmonic content of the rectangular or triangular waveform is adjusted until the desired number of fast satellite drops suitable for desired image formation are formed in the stream of primary drops. In a preferred embodiment, the desired number of fast satellites is a maximum of three.

34 Claims, 16 Drawing Sheets

METHOD AND APPARATUS FOR CONTINUOUS INK JET PRINTING WITH A NON-SINUSOIDAL DRIVING WAVEFORM

FIELD OF THE INVENTION

The present invention relates generally to ink jet printers, and more particularly to an apparatus and method in a continuous ink jet printing system for producing drops of ink having desirable satellite formation characteristics.

BACKGROUND OF THE INVENTION

Continuous ink jet printing systems operate by continuously discharging a stream of pressurized ink through a nozzle toward a substrate to be marked. The nozzle is coupled to a piezoelectric transducer or the like which is vibrated with a sinusoidal waveform at a frequency that causes the stream of ink to break off into substantially uniform drops shortly after being discharged from the nozzle.

Upon breakoff, each of the drops is subsequently passed through a selectively variable electric field associated with a charging electrode which selectively charges the drop. The amount of charge received by each drop is ordinarily controlled by adjusting the level of a voltage on the charging electrode that generates the electric field. Thereafter, an electric field generated by deflection plates deflect the drop according to the charge thereon. By appropriately varying the charging voltage and synchronizing it with the formation of each drop according to the amount of deflection desired therefor, drops are selectively deflected to form characters or other images on a moving target substrate. Drops that are not used for character or image formation are substantially uncharged and intercepted by a catcher for recirculation through the system. Two such systems are described in U.S. Pat. Nos. 3,683,396 and 3,972,474, and have been assigned to the same assignee of the present invention.

During the formation of a drop, the drop remains temporarily connected to the stream by a thin filament of ink. Eventually the drop and filament separate from each other and from the stream, whereby the filament may form its own, smaller drop known as a satellite.

If the satellite has a speed that is greater than that of its associated primary drop, it is known as a fast satellite. Conversely, if the satellite has a speed that is slower than that of its primary drop, it is known as a slow satellite. Factors in determining how the drops and satellites will break off from the stream include the frequency and amplitude of the driving signal, the physical properties of the ink, and the geometric characteristics of the nozzle.

A fast satellite catches up to and recombines with its primary drop, while a slow satellite is caught by and combines with the next subsequently-formed primary drop that trails it. Since each satellite may be charged with charge that was removed from its associated primary drop, fast satellites recombine with the primary drop without adversely affecting the charge-dependent amount of deflection of the primary drop. However, a slow satellite may alter the desired amount of charge on the subsequent drop. This results in an unintended amount of charge on either the primary drop or the subsequent drop, or on both drops, and therefore results in an unintended amount of deflection of the drops, thereby adversely affecting the quality of the resultant image. Thus, typical continuous ink jet printers are arranged to suppress satellite formation as much as possible, or at least to produce fast satellites in a manner that does not degrade the resultant image. This is ordinarily accomplished by increasing the amplitude of a sinusoidal driving waveform producing the nozzle vibration until satellite formation suitable for desirable image quality is achieved.

A condition wherein no more than three fast satellites are present in the drop stream (i.e., the third primary drop from the nozzle and its corresponding fast satellite have recombined before a new satellite is formed near the breakoff point with the next primary drop) has been found to be an acceptable condition for many printing operations. Accordingly, it is often desirable to arrange the system and the parameters influencing the breakoff characteristics so that no more than three fast satellites are produced in the drop stream, a printing condition known as a "three fast satellite" condition.

However, with certain inks and/or nozzles, desirable satellite conditions cannot be consistently achieved using conventional methods of breaking up an ink stream. While increasing the amplitude of the excitation signal producing the vibration to some extent desirably regulates satellite formation in some ink and nozzle combinations, other ink and nozzle combinations are unable to achieve acceptable satellite conditions, or require increases in driving amplitude that exceed the power driving capabilities of currently existing nozzle drive circuitry. For example, even at very large amplitudes, sinusoidal waveforms cannot achieve a fast satellite condition suitable for desirable image quality with certain inks.

In particular, continuous ink jet printing with hot-melt inks poses a substantial difficulty. Hot-melt inks exist in a solid phase at room temperature and are heated to a liquid phase for discharging. Satellite formation difficulties arise primarily as a result of the relatively low surface tension and high viscosity of hot-melt inks.

For example, typical liquid inks have a viscosity of 2 centipoise, a surface tension of 40 millinewtons per meter and a density of 1000 kilograms per cubic meter, versus a typical hot-melt ink viscosity of 10 centipoise, a surface tension of 18 millinewtons per meter and a density of 950 kilograms per cubic meter.

As a result, even large increases in driving amplitude have been found incapable of adequately breaking off hot-melt ink drops to form desired satellite conditions. Nevertheless, despite the drawbacks, continuous ink jet printing with hot melt inks is desirable to the industry because hot-melt inks have faster drying times compared to liquid inks. In addition, hot-melt inks substantially do not contain environmentally harmful volatile organic compounds.

OBJECTS AND SUMMARY OF THE INVENTION

Accordingly, it is an object of the present invention to provide an apparatus and method for producing drops of ink in a continuous ink jet printing system wherein desirable satellite formation, resulting in desirable printing conditions, are achieved for an increased variety of inks.

It is another object to provide an apparatus and method as characterized above that functions with an increased variety of nozzle types.

It is yet another object to provide an apparatus and method as characterized above that reduces the amount of power required to drive a nozzle while achieving desired satellite and printing conditions.

It is a related object to achieve desired satellite conditions without increasing the amplitude of the driving signal above customary excitation levels.

It is yet another object to provide a method and apparatus of the above kind that simplifies the electrical circuitry for driving a continuous ink jet nozzle.

It is still another object to provide a method and apparatus of the above kind that facilitates the use of hot-melt inks in a continuous ink jet printing system.

It is a resulting feature of the invention that improved cost savings and reliability are attained.

Briefly, the invention provides an apparatus and method for producing drops in a drop stream that have a desired number of fast satellite drops formed in the drop stream. An ink, which may be a hot-melt ink in its liquid phase, is pressurized for continuous flow to a nozzle and a periodic non-sinusoidal waveform such as a rectangular or triangular waveform is generated at a fixed frequency. The waveform is applied, ordinarily via an amplifier, to a transducer coupled to the nozzle such that the nozzle vibrates and the ink flow is perturbed and discharged from the nozzle as primary drops with satellite drops formed therewith. A means for adjusting the harmonic content of the rectangular or the triangular waveform provides that the desired maximum number and desired direction of relative motion of the satellite drops are achieved in the drop stream. The desired number of fast satellite drops may be zero, although in other preferred embodiments, the desired number of fast satellites is a maximum of three.

Other objects and advantages will become apparent from the following detailed description when taken in conjunction with the attached drawings, in which:

Figure 1:
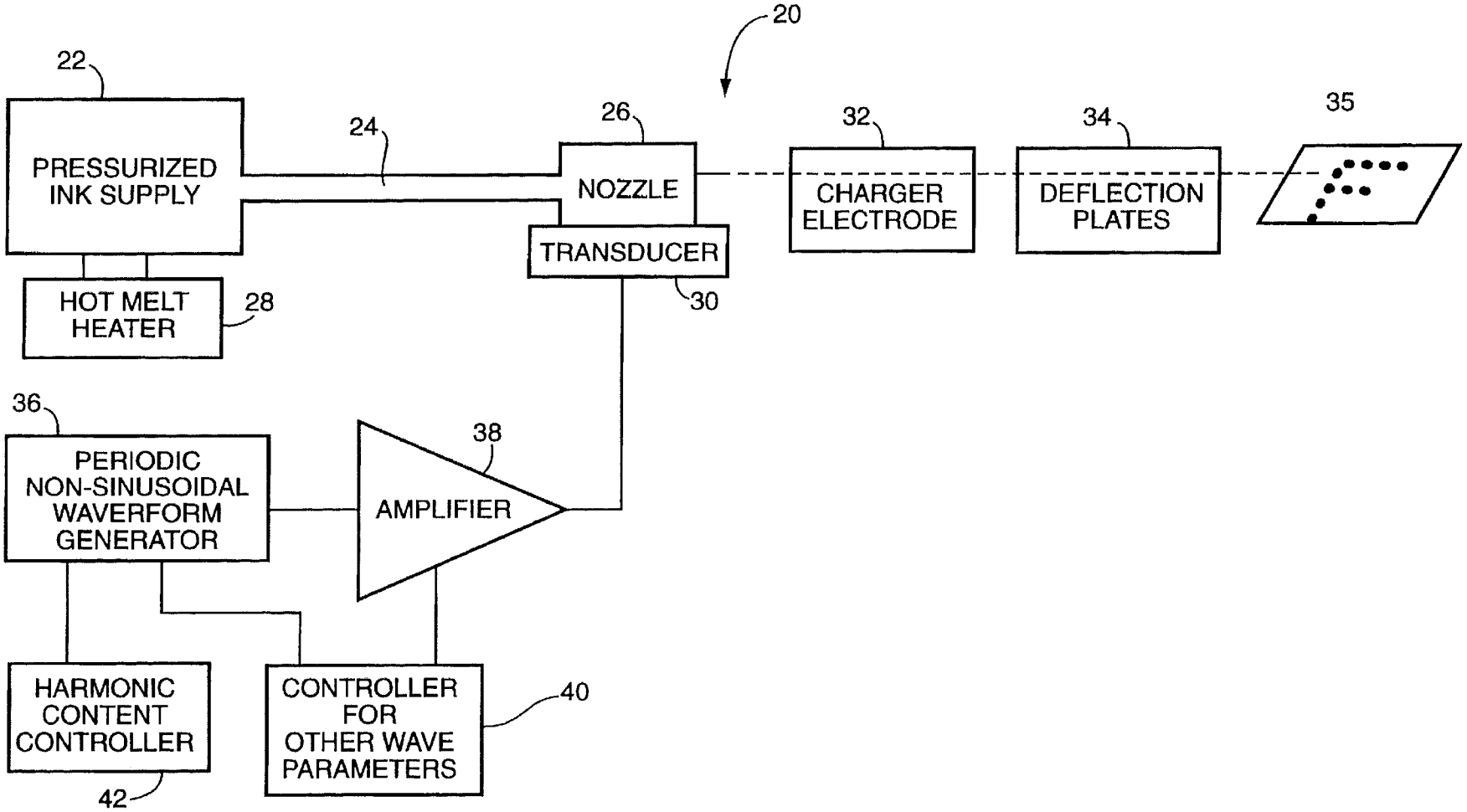
FIG. 1 is a functional block diagram illustrating components of a continuous ink jet printing system constructed in accordance with a preferred embodiment of the present invention.

While the invention is amenable to various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention.

DETAILED DESCRIPTION OF THE PREFERRED EMBODIMENT

Turning now to the drawings and referring first to FIG. 1, there is shown a continuous ink jet printing system 20 constructed in accordance with a preferred embodiment of the present invention. The printing system 20 comprises a pressurized supply of ink 22 connected by a suitable conduit 24 to a nozzle 26 which provides a pressurized ink stream. A pressure source (not shown) may be utilized to pressurize the ink. In the embodiment described, the ink is of a type known as hot-melt and a heater 28 is provided to liquify the ink in a known manner. One such hot-melt ink jet printing system is described in the copending application by Sutera et al. (Attorney Docket No. 59562) entitled "Continuous Ink Jet Printing System For Use With Hot-Melt Inks." Of course, other types of inks may alternatively be used with the present invention, including inks that exist in a liquid phase at room temperature and which consequently do not require a heater.

To break the ink into droplets of substantially uniform size, a transducer 30 is provided and coupled with the nozzle 26 in a manner that imparts vibration to the nozzle 26, thereby breaking the continuous flow of ink into primary drops and satellite drops. Once broken from the stream, the ink drops are charged by a charging electrode 32 and deflected using deflection plates 34 onto a target substrate 35 at an appropriate location for forming a desired image. Because not all of the available drops are needed to form a given image, an ink recirculation system (not shown) is provided to collect and reuse the extra drops.

In accordance with one aspect of the invention, a non-sinusoidal periodic waveform having a controllable harmonic content is employed to drive the transducer 30. Examples of such a waveform include rectangular, quasi-rectangular, triangular, quasi-triangular, trapezoidal, and quasi-trapezoidal waveforms.

To generate such a periodic non-sinusoidal waveform, a suitable electronic waveform generation means comprising a periodic non-sinusoidal waveform generator 36 and an amplifier 38 is provided to supply the desired waveform of a suitable driving frequency and amplitude to the transducer 30. A typical frequency is on the order of 66 kilohertz and a typical amplitude is on the order of 100 volts peak to peak, which is not necessarily symmetric about ground. By way of example, the waveform generator 36 may be a rectangular waveform generator (FIG. 26) or alternatively may be a triangular waveform generator (FIG. 27) as described in more detail below.

Although not necessary to practice the invention, a controller 40 is provided to control certain waveform parameters such as the amplitude and frequency. As can be readily appreciated, the controller 40 comprises a set of potentiometers or the like. Alternatively, the controller 40 may comprise more complex electronic circuitry such as a microprocessor-based frequency and gain control circuit.

In accordance with another aspect of the invention, there is provided a means for adjusting the harmonic content of the periodic non-sinusoidal waveform, designated as a harmonic content controller 42. By altering the harmonic content of the driving waveform, the formation and relative motion of satellites is affected.

In a rectangular or triangular waveform, a change in the harmonic content appears as a change in the duty cycle of the waveform. Duty cycle is defined for a rectangular waveform as the percentage of time that the waveform is at its high amplitude over the total period of one waveform cycle (high amplitude plus low amplitude):

$$\text{Duty cycle}=[T_{high}/(T_{high}+T_{low})]*100\%$$

For a triangular wave, duty cycle is defined as the time the signal takes to rise from its lowest to highest amplitude divided over the total period of one waveform cycle (the rise time from lowest amplitude to highest amplitude plus fall time from highest amplitude to lowest amplitude):

$$\text{Duty cycle}=[T_{rise}/(T_{rise}+T_{fall})]*100\%$$

Figure 2:
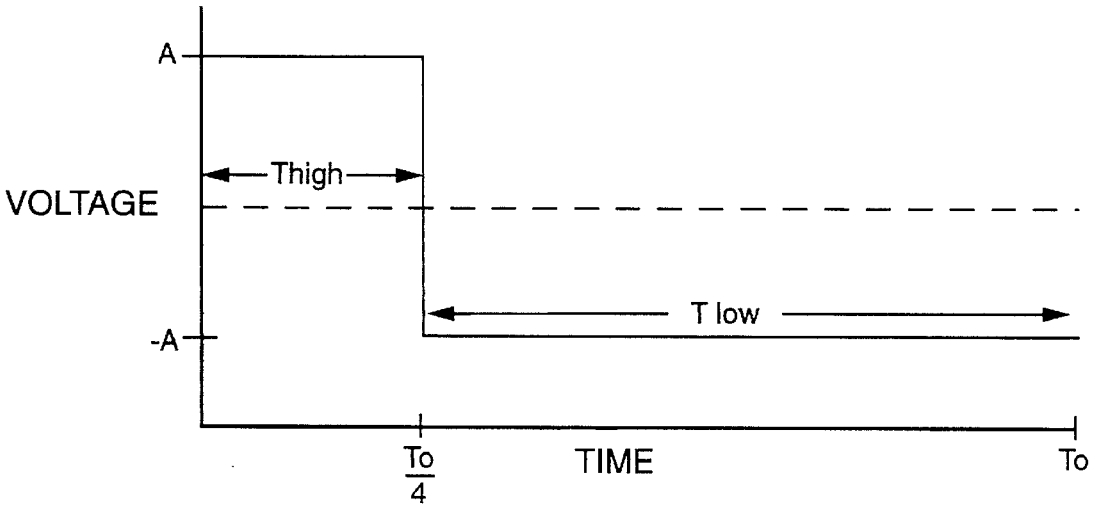
FIGS. 2 and 4 are graphs representing two distinct types of rectangular waveforms which can be applied via a transducer to a continuous ink jet printing nozzle to generate desirable satellite conditions according to the invention.
Figure 6:
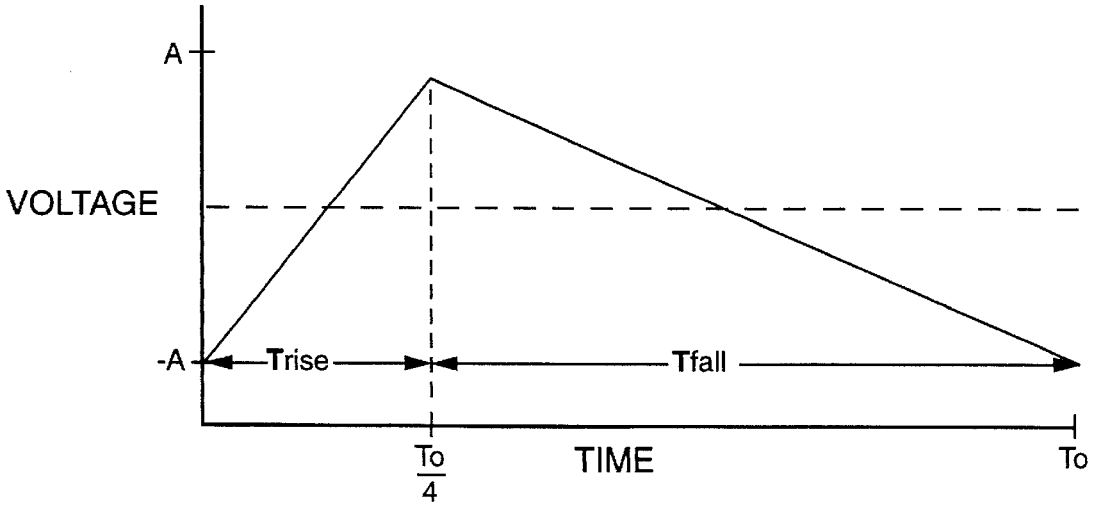
FIGS. 6 and 8 are graphs representing two distinct types of triangular waveforms that generate desirable satellite conditions according to the invention.

By way of example, FIG. 2 illustrates one cycle of a rectangular waveform having a twenty-five percent duty cycle (twenty-five percent high, seventy-five percent low over one complete waveform period $T_0$). FIG. 6 illustrates one cycle of a triangular waveform having a twenty-five percent duty cycle (twenty-five percent of the period rising, seventy-five percent falling).

Any repetitive waveform of period $T_0$ can be represented as a Fourier series according to the formula:

$$f(t)=a_0/2+\sum_{n=1}^{n=\infty}[(a_n\cos(2n\pi t/T_0)+(b_n\sin(2n\pi t/T_0)]$$

where $$a_n=2/T_0\int_0^{T_0}f(t)\cos(2n\pi t/T_0)dt$$

for $n=0, 1, 2, \ldots$ and $$b_n=2/T_0\int_0^{T_0}f(t)\sin(2n\pi t/T_0)dt$$

for $n=1, 2, \ldots$

When $a_n\neq 0$ and $b_n\neq 0$, an alternate form of the Fourier series can be expressed as:

$$f(t)=a_0/2+\sum_{n=1}^{n=\infty}c_n\sin(2n\pi t/T_0+\phi_n)$$

where $$a_n=c_n\sin\phi_n,$$
$$b_n=c_n\cos\phi_n,$$

$$c_n=\sqrt{a_n^2+b_n^2}$$

and $$\phi_n=\arctan(a_n/b_n).$$

The coefficients $c_0$ through $c_n$ correspond to the harmonics of the Fourier expansion, and are commonly referred to as the Fourier coefficients.

For a rectangular waveform of amplitude A, period $T_0$ and duty cycle δ, the Fourier coefficients are given by:

$$a_0=4A(\delta-\tfrac{1}{2})$$

$$c_n=(A\sqrt{8}/n\pi)\sqrt{1-\cos(2n\pi\delta)}$$

for $n=1, 2, \ldots$ and the phase angles by:

$$\phi_n=\arctan[\sin(2n\pi\delta)/(1-\cos(2n\pi\delta))] \text{ for } n=1,2,\ldots$$

Figure 3:
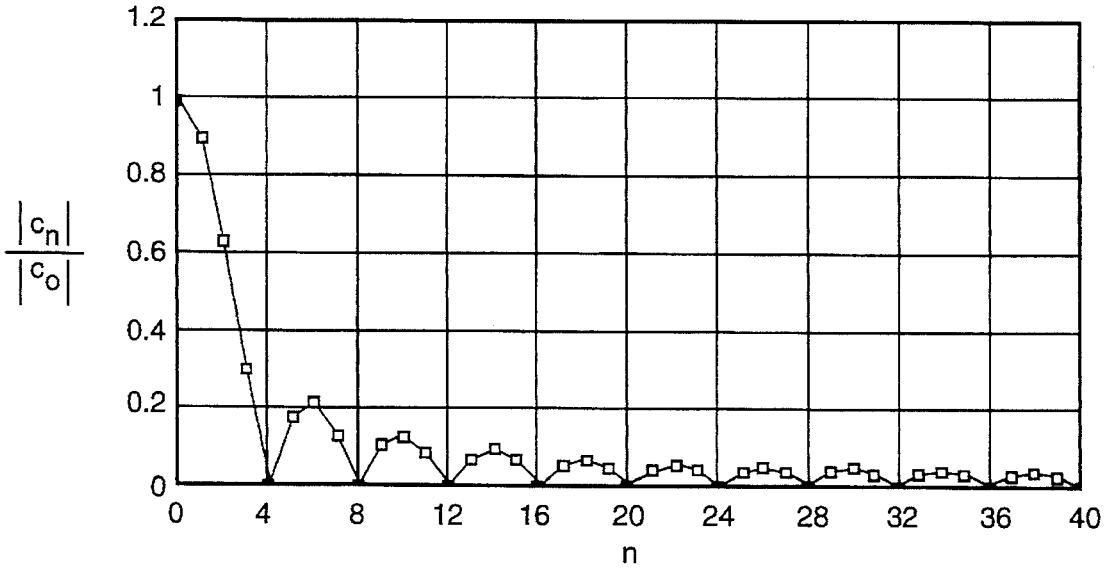
FIGS. 3 and 5 are graphs representing the Fourier coefficients of the waveforms of FIGS. 2 and 4, respectively.

The Fourier coefficients for the twenty-five percent duty cycle rectangular waveform of FIG. 2 for n=0 to 40 are shown in FIG. 3. As can be seen from FIG. 3 and/or by solving the formula for $c_n$, in this rectangular waveform every multiple of a fourth harmonic ($c_4$, $c_8$, $c_{12}$ and so on) equals 0. This plays a significant role in acceptable satellite formation for certain types of inks and nozzles.

Similarly, for a triangular waveform, of amplitude A, period $T_0$, and duty cycle δ, the Fourier coefficients are given by:

$$a_0=0$$

$$c_n=[A\sqrt{2}/n^2\pi^2\delta(1-\delta)]\sqrt{1-\cos(2n\pi\delta)}$$

for $n=1, 2, \ldots$ and the phase angles by:

$$\phi_n=\arctan[\cos(2n\pi\delta)-1/\sin(2n\pi\delta)] \text{ for } n=1,2,\ldots$$

Figure 7:
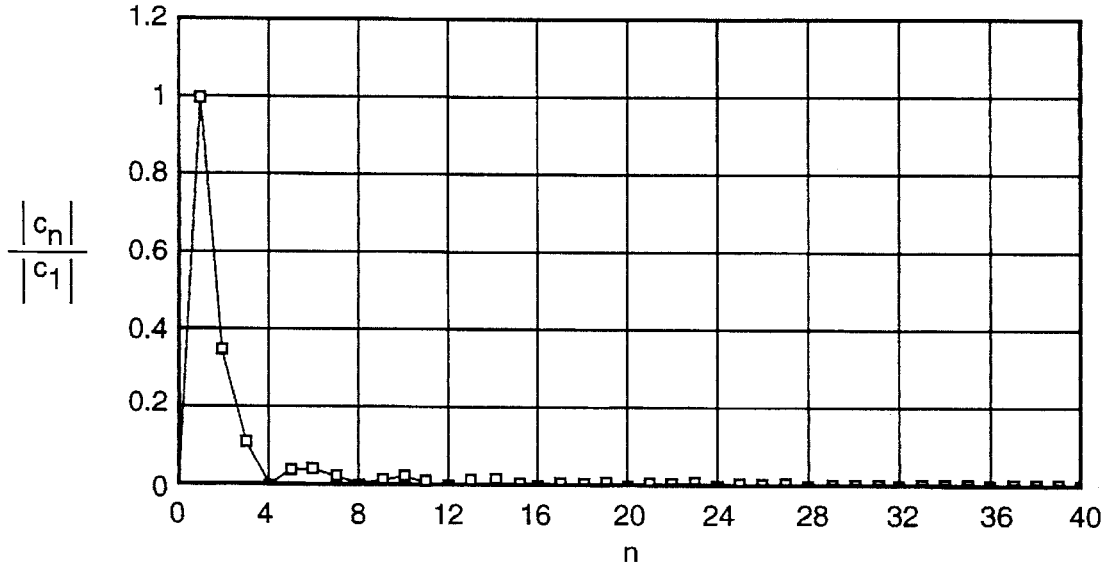
FIGS. 7 and 9 are a graphs representing the Fourier coefficients of the waveforms of FIGS. 6 and 8, respectively.
Figure 8:
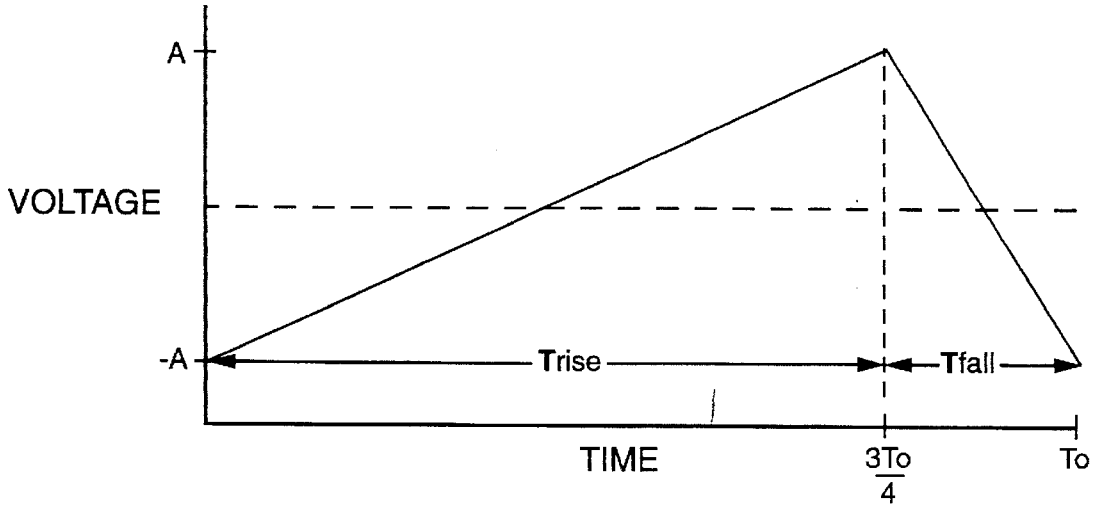
Figure 9:
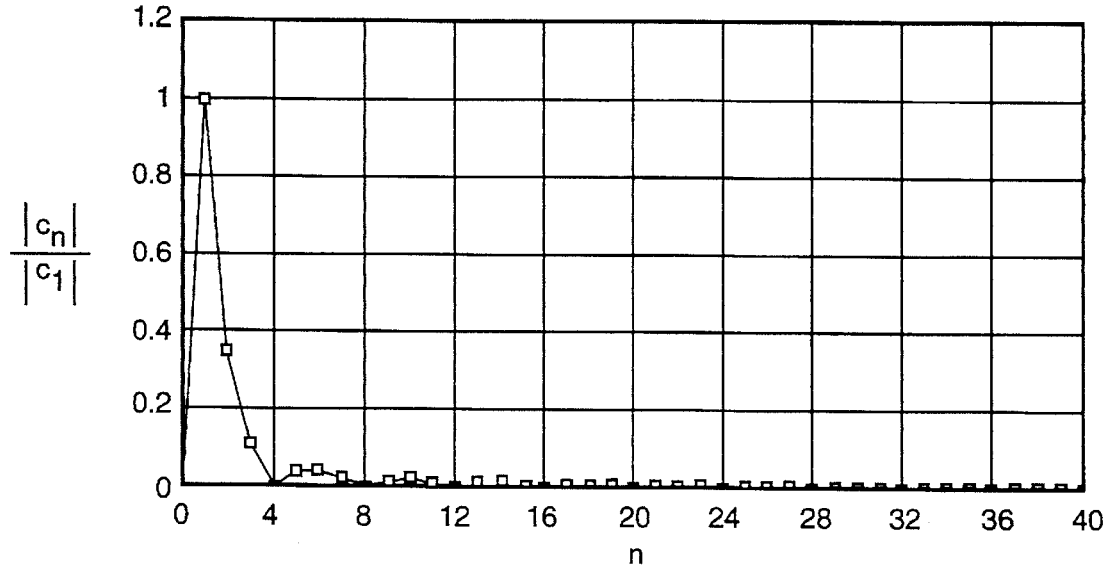
Figure 10:
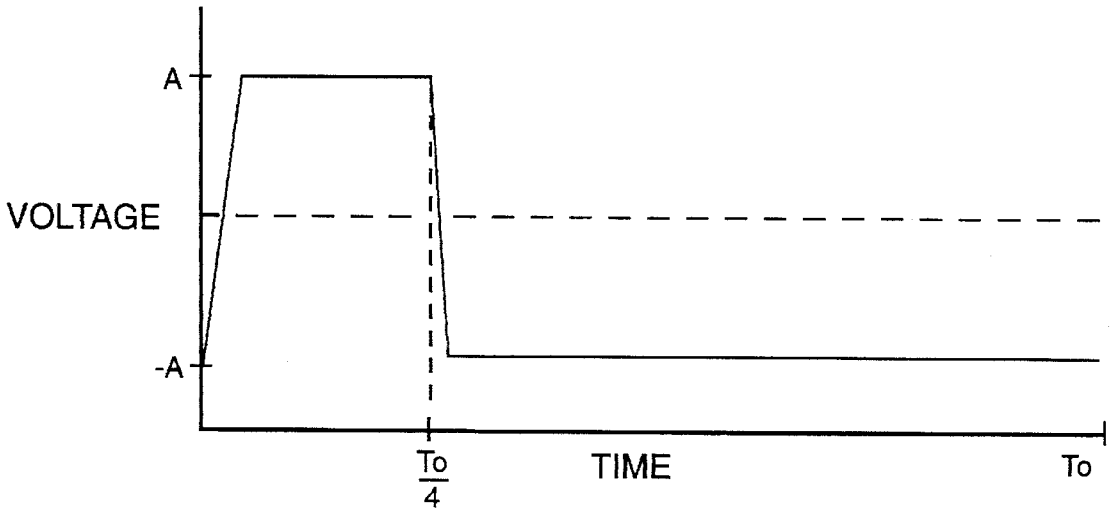
FIGS. 10, 12, 14 and 16 are graphs representing four distinct types of trapezoidal waveforms that generate desirable satellite conditions according to the invention.
Figure 11:
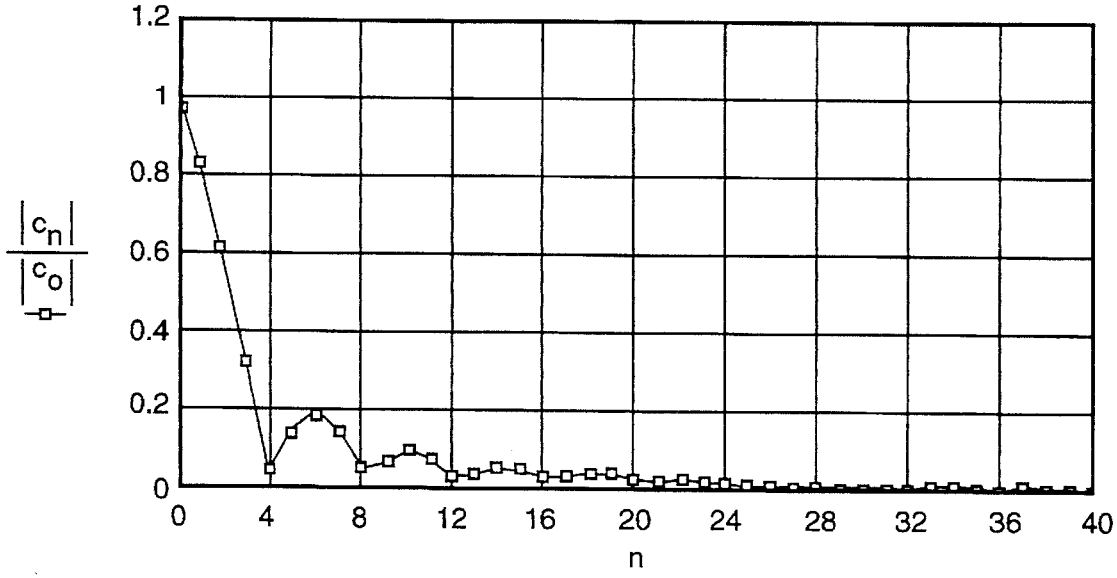
FIGS. 11, 13, 15 and 17 are graphs representing the Fourier coefficients of the waveforms of FIGS. 10, 12, 14 and 16, respectively.
Figure 12:
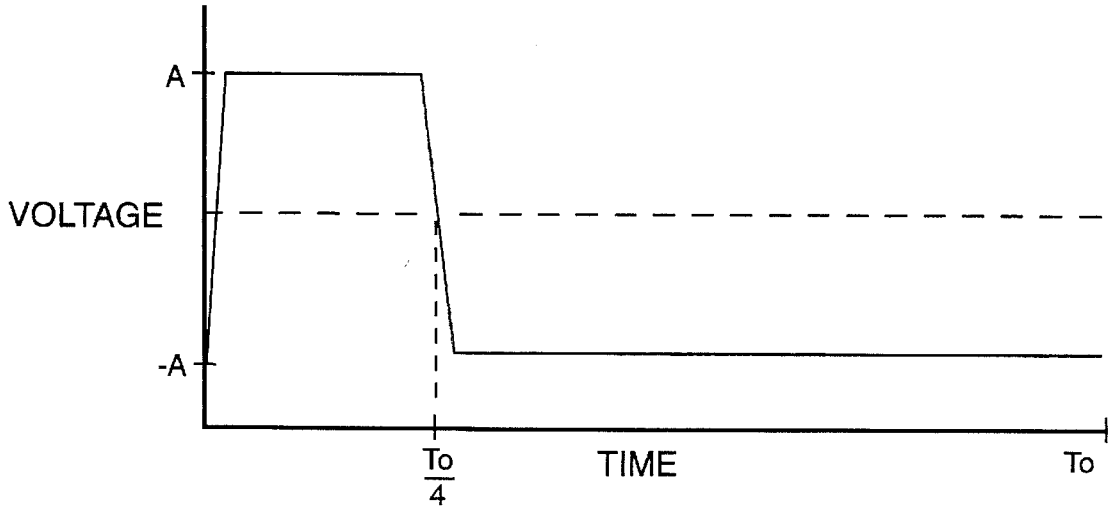
Figure 13:
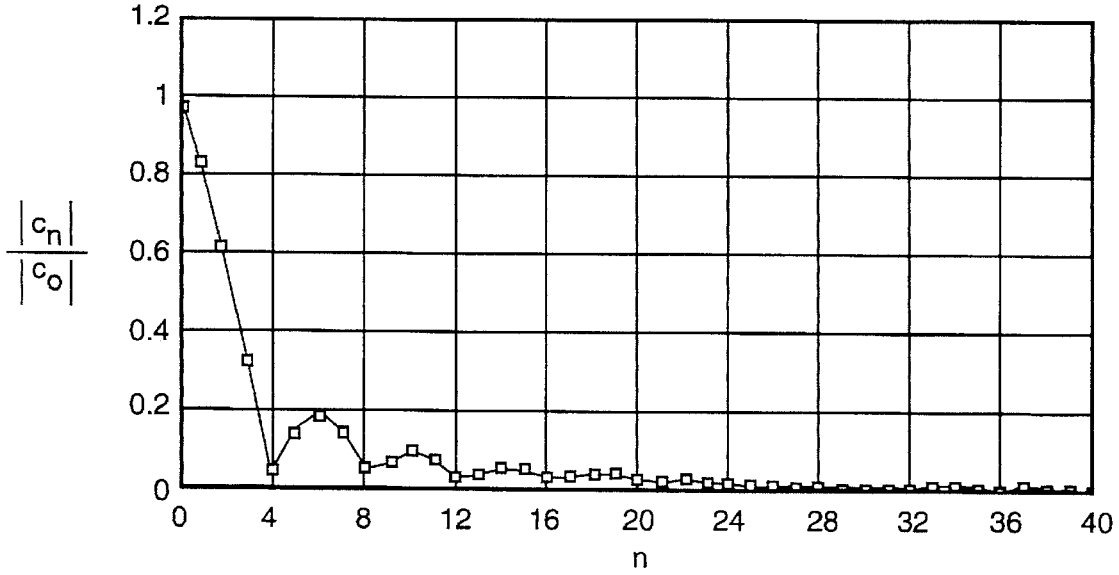
Figure 14:
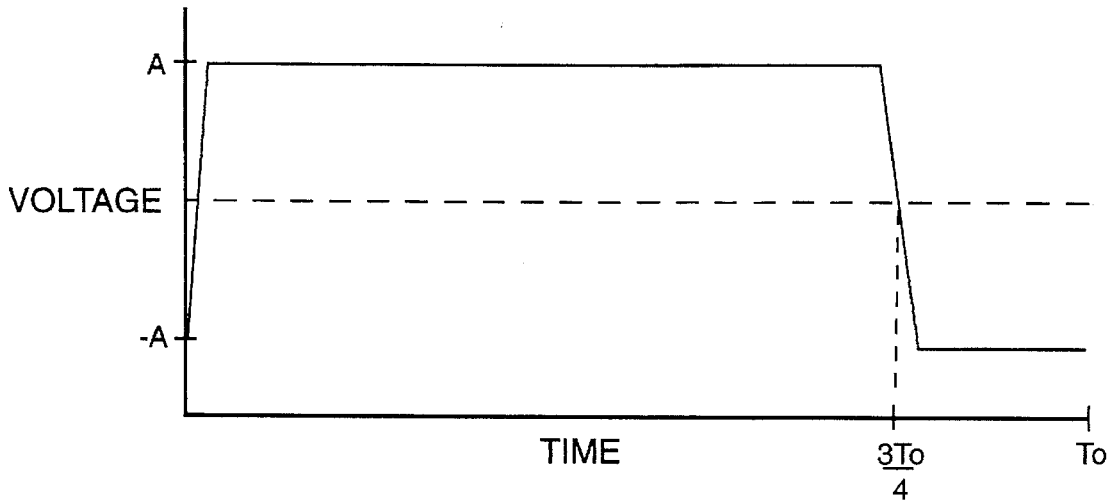
Figure 15:
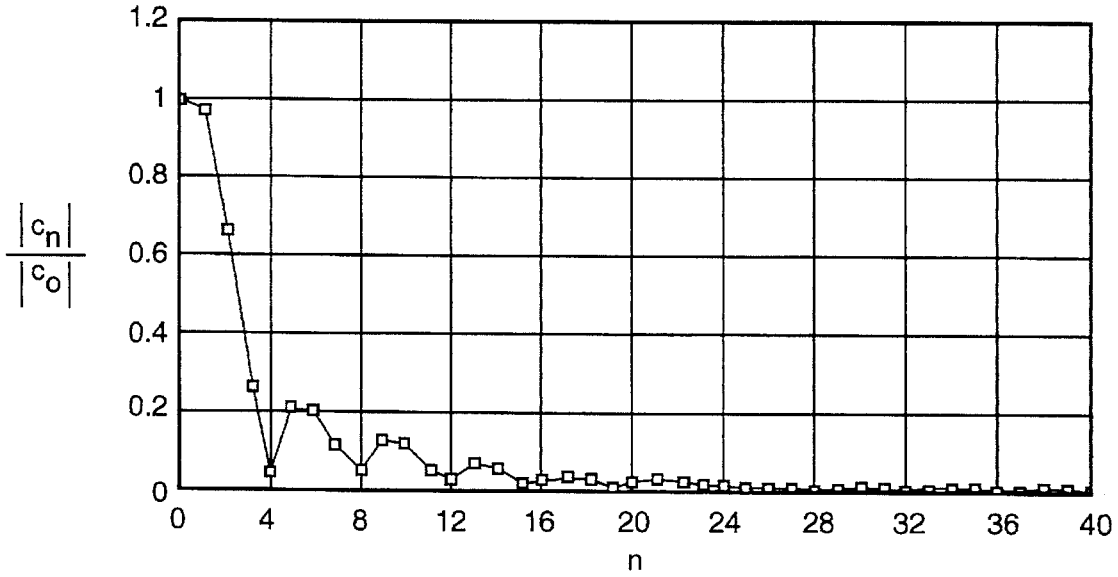
Figure 16:
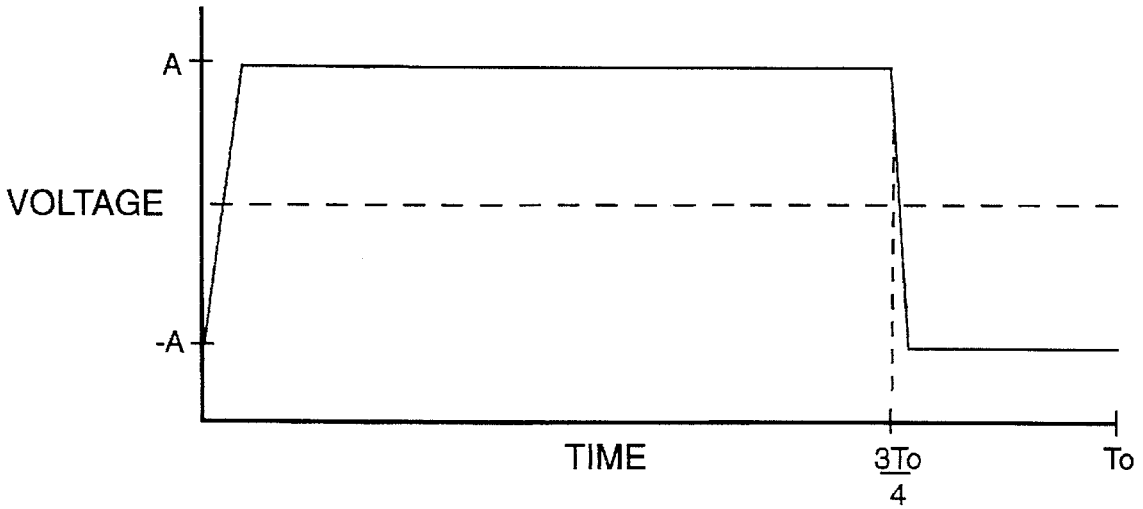
Figure 17:
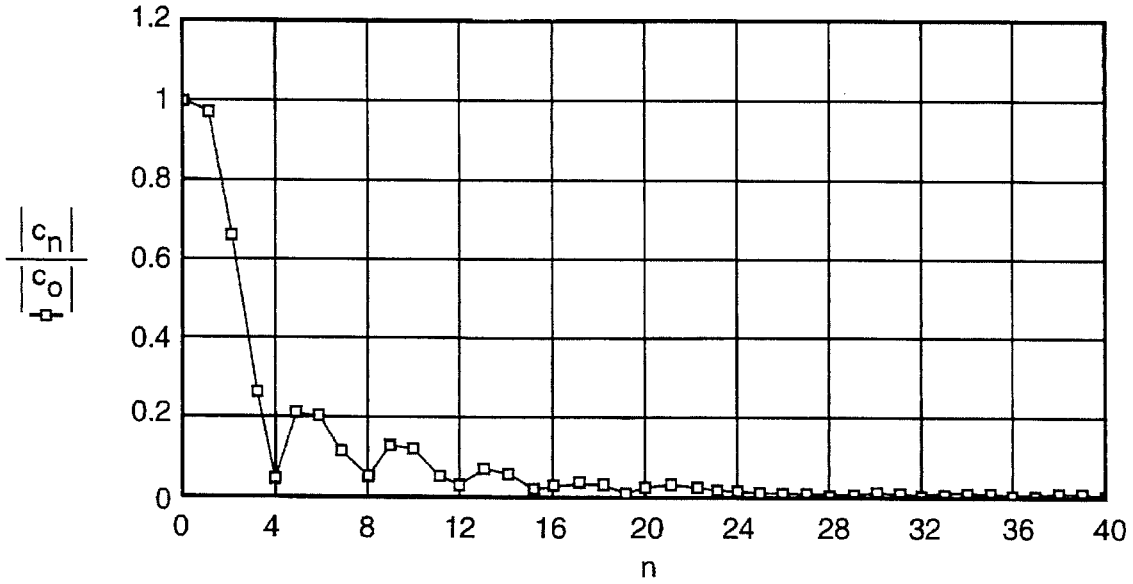
Figure 18:
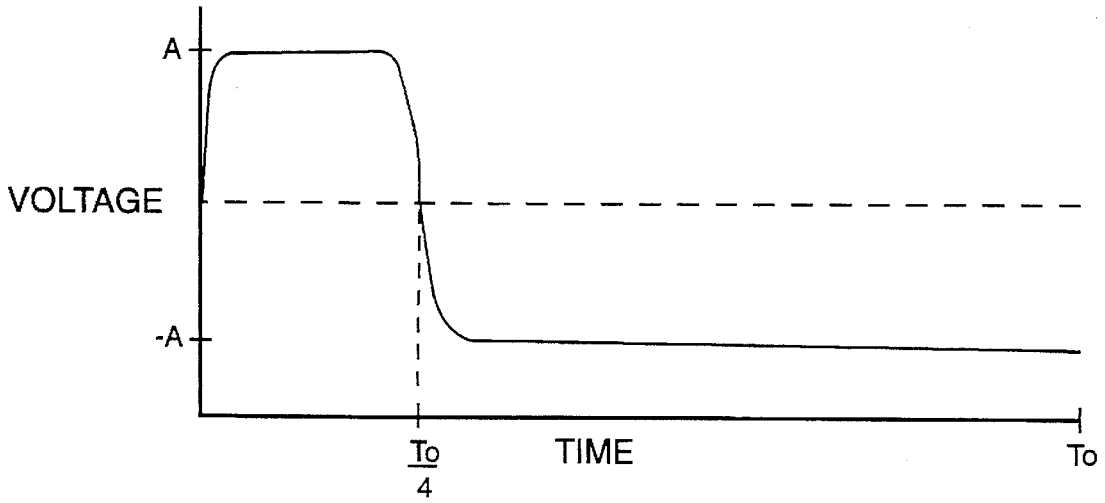
FIGS. 18, 20, 22 and 24 are graphs representing four distinct types of quasi-rectangular waveforms that generate desirable satellite conditions according to the invention.
Figure 19:
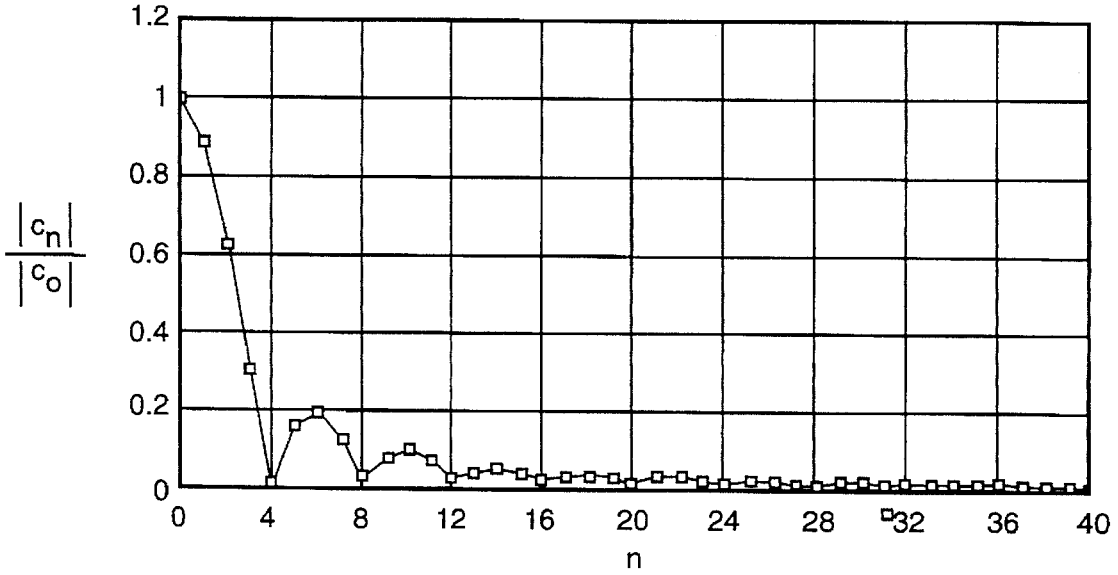
FIGS. 19, 21, 23 and 25 are graphs representing the Fourier coefficients of the waveforms of FIGS. 18, 20, 22 and 24, respectively.
Figure 20:
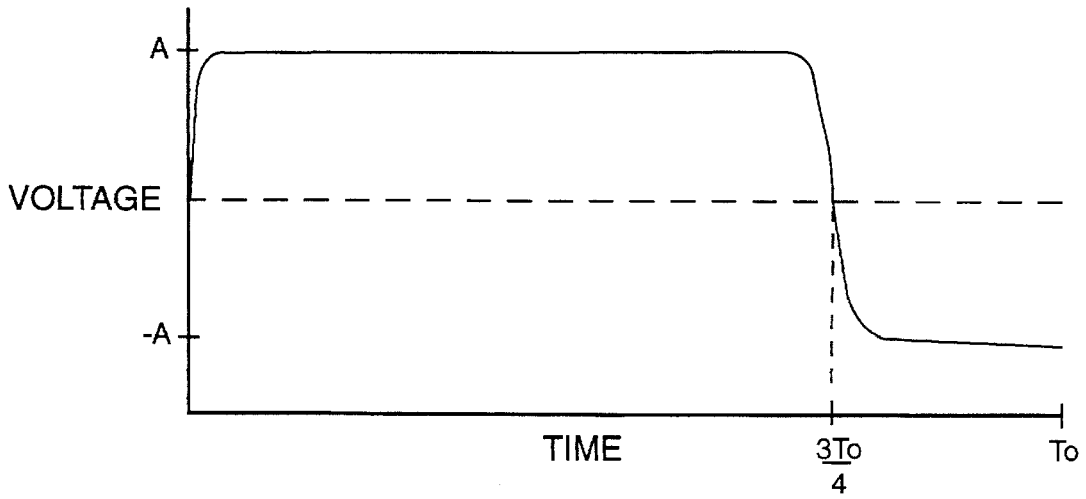
Figure 21:
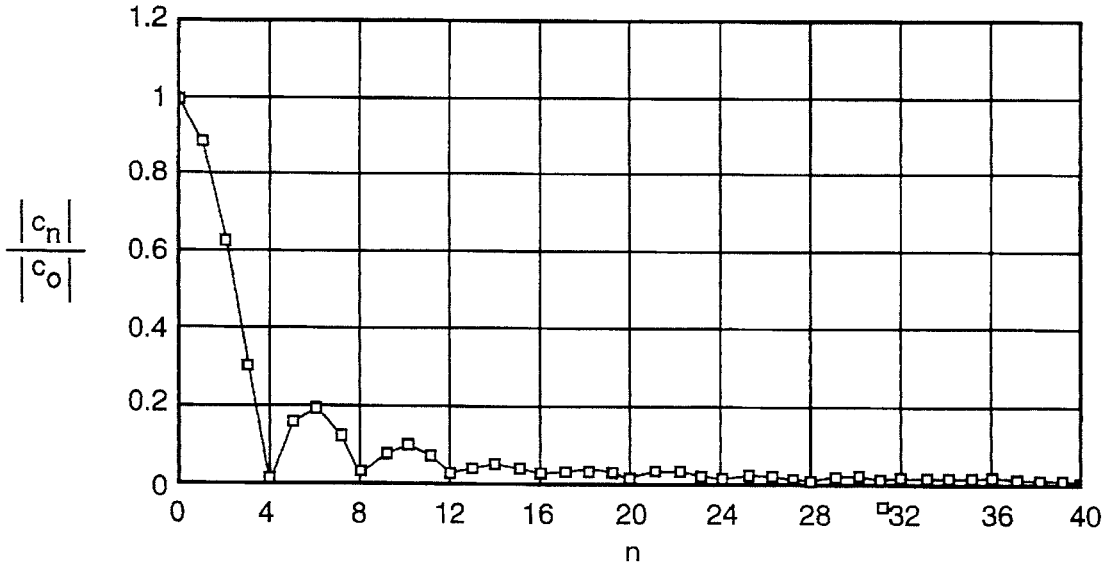
Figure 22:
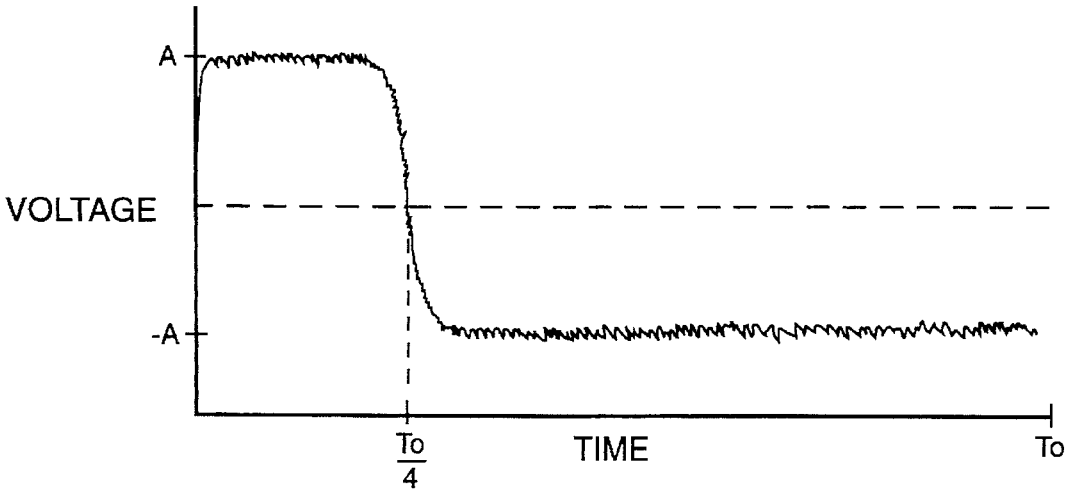
Figure 23:
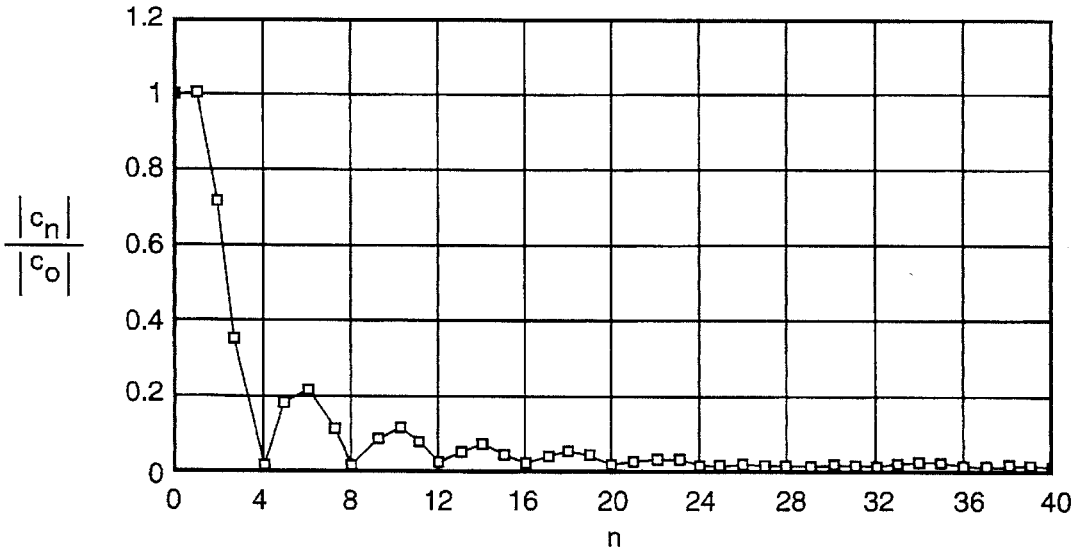
Figure 24:
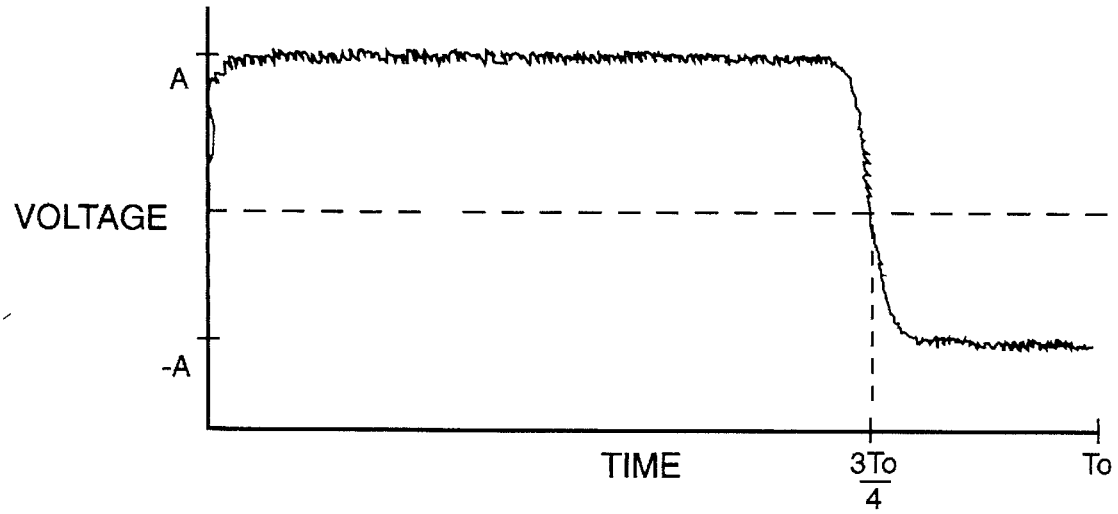
Figure 25:
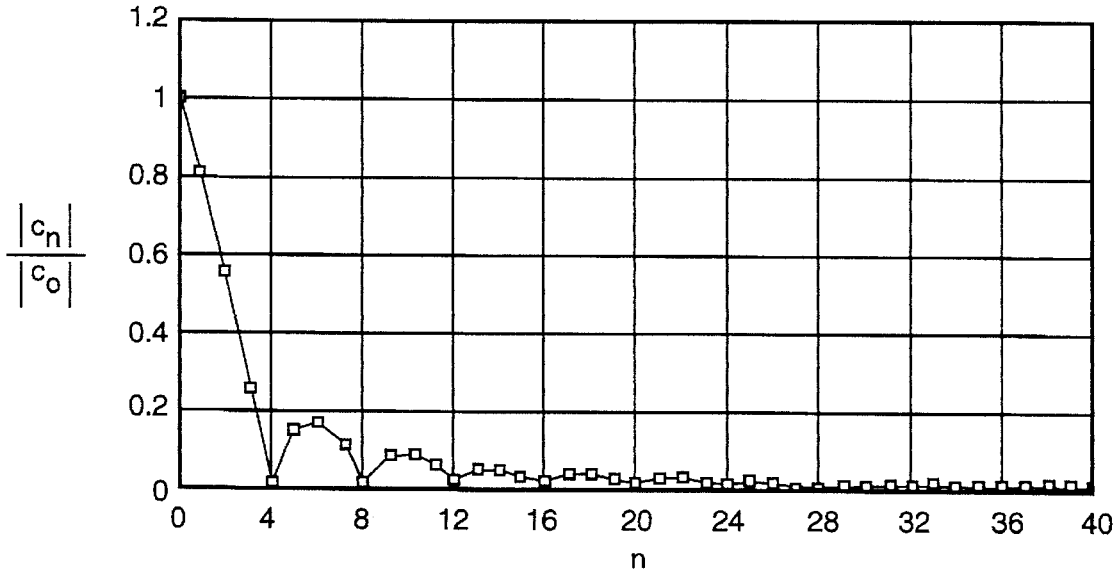

The Fourier coefficients for the twenty-five percent duty cycle triangular waveform of FIG. 6 for n=0 to 40 are shown in FIG. 7. As can be seen from FIG. 7 and/or by solving the formula for $c_n$, in this triangular waveform every multiple of a fourth harmonic ($c_4$, $c_8$, $c_{12}$ and so on) equals 0, as with the rectangular waveform.

The waveforms (and their corresponding Fourier coefficients) illustrated in FIGS. 10–25 will not be described in detail herein for purposes of simplicity. However it can be readily appreciated from an inspection of the drawings and/or by solving well-known equations that multiples of the fourth harmonic are either zero or near zero for these waveforms. Again, this plays a significant role in acceptable satellite formation for certain types and combinations of inks and nozzles.

The waveforms illustrated herein were found to successfully break up continuous jets of various types of inks using prototype nozzles, achieving a three fast satellite condition suitable for desirable image formation when the transducer was driven by a commercially available signal generator and power amplifier at a frequency of 66 kilohertz at various peak-to-peak amplitudes between 50 and 200 volts. In particular, rectangular waves were found to successfully break up hot-melt inks in a prototype nozzle. In contrast, a conventional sine wave with comparable amplitude and frequency was unable to acceptably break up the hot-melt ink jet using this same ink and nozzle combination. Indeed, acceptable breakoff did not occur even when driving the transducer with a 300 volt peak-to-peak sine wave, the maximum test voltage available, which is an amplitude that far exceeds the power driving capabilities of currently existing nozzle drive circuitry.

Figure 4:
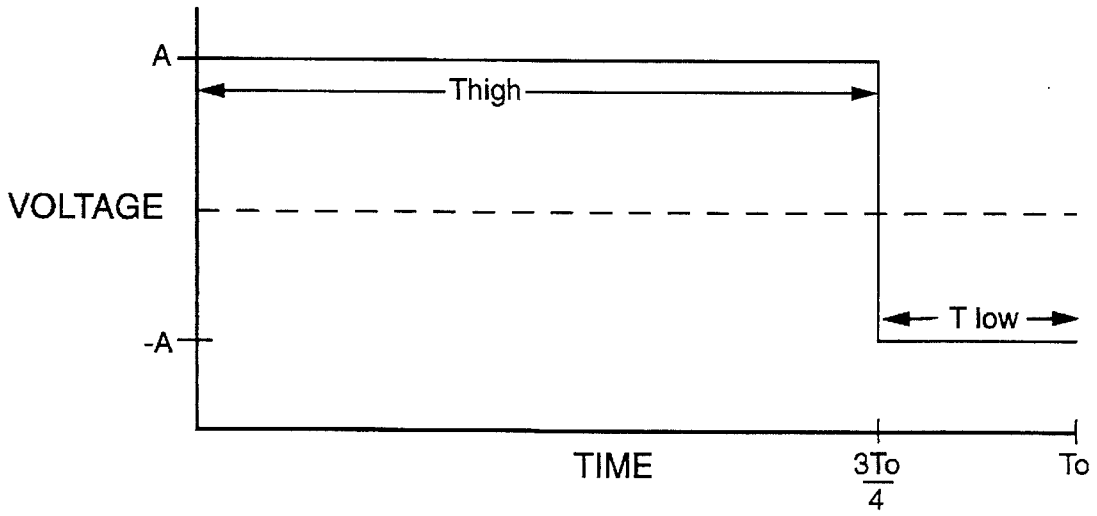
Figure 5:
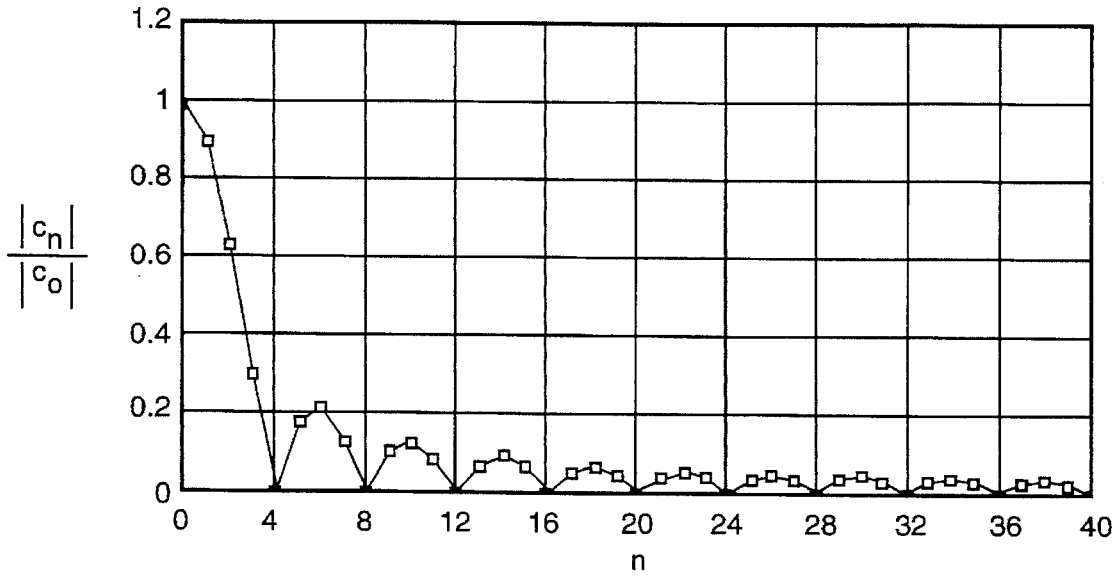

It should be noted that certain of the waveforms have the same Fourier coefficients as their effectively inverted counterpart waveforms. For example, the rectangular waveform of FIG. 2 having a twenty-five percent duty cycle has Fourier coefficients that are equivalent to the Fourier coefficients of the rectangular waveform of FIG. 4 having a seventy-five percent duty cycle. However, the phase shifts $\phi_n$ are different for the two duty cycles. It has been found that one of the duty cycles provides better print quality when the driving frequency is less than the frequency at which the nozzle fluid chamber resonates, while the counterpart duty cycle provides better print quality when the driving frequency is greater than this resonant frequency.

Periodic non-sinusoidal waveforms having other duty cycles can also produce desired satellite formations suitable for desirable image formation in other types of ink and nozzle combinations, and at far lower drive levels than required by sine waves. For example, with certain inks and nozzles, periodic non-sinusoidal waves having duty cycles ranging from between sixty and ninety percent high, or alternatively between forty and ten percent high are far more effective in achieving acceptable print quality than comparable sinusoidal driving waveforms. As an added benefit, the electronics required to generate such waveforms are less complex and more cost-effective than the electronics required to generate sine waves, and thus reliability and cost benefits are achieved with the present invention.

It can be readily appreciated that rectangular waveforms in general have finite rise and/or fall times and to this extent may not be exactly rectangular, but for practical purposes, a waveform such as depicted in FIG. 2 may be considered as purely rectangular because of its sufficiently fast rise and fall time relative to the total time period of one complete waveform cycle.

Moreover, a waveform having a substantially rectangular shape, such as the waveforms of FIGS. 18, 20, 22 and 24 which have slower and more rounded rise and fall times, have essentially similar Fourier coefficients as pure rectangular waveforms, and have similarly beneficial nozzle drive characteristics. As shown in FIGS. 19, 21, 23 and 25, wherein the coefficients for the exemplary quasi-rectangular. waveforms of FIGS. 18, 20, 22, and 24 are graphed for the first forty harmonics, every fourth coefficient is nearly zero. Accordingly, as used herein, the phrase "rectangular waveform" is intended to include all substantially rectangular waveforms, including pure rectangular waveforms, quasi-rectangular waveforms, and trapezoidal waveforms such as those depicted in FIGS. 10, 12, 14 and 16.

Analogous to the rectangular waveform, quasi-triangular waveforms have essentially similar Fourier coefficients as pure triangular waveforms, and have similarly beneficial nozzle driving characteristics. Thus, the phrase "triangular waveform" is intended to include all substantially triangular waveforms, including pure triangular waveforms and quasi-triangular waveforms.

Turning now to an explanation of the operation of the invention, the tailoring of the harmonic content of the periodic non-sinusoidal waveform for a particular ink and nozzle combination is ordinarily performed by carefully observing the actual satellite formation and/or studying the placement accuracy of the resultant dots forming an image on a target surface. To initialize the printing system 20 of FIG. 1, the duty cycle of the periodic non-sinusoidal waveform, and if necessary the amplitude thereof, is varied until the desired satellite condition suitable for desirable image formation is achieved. Once achieved, the waveform is then established for a given ink and nozzle combination.

Figure 26:
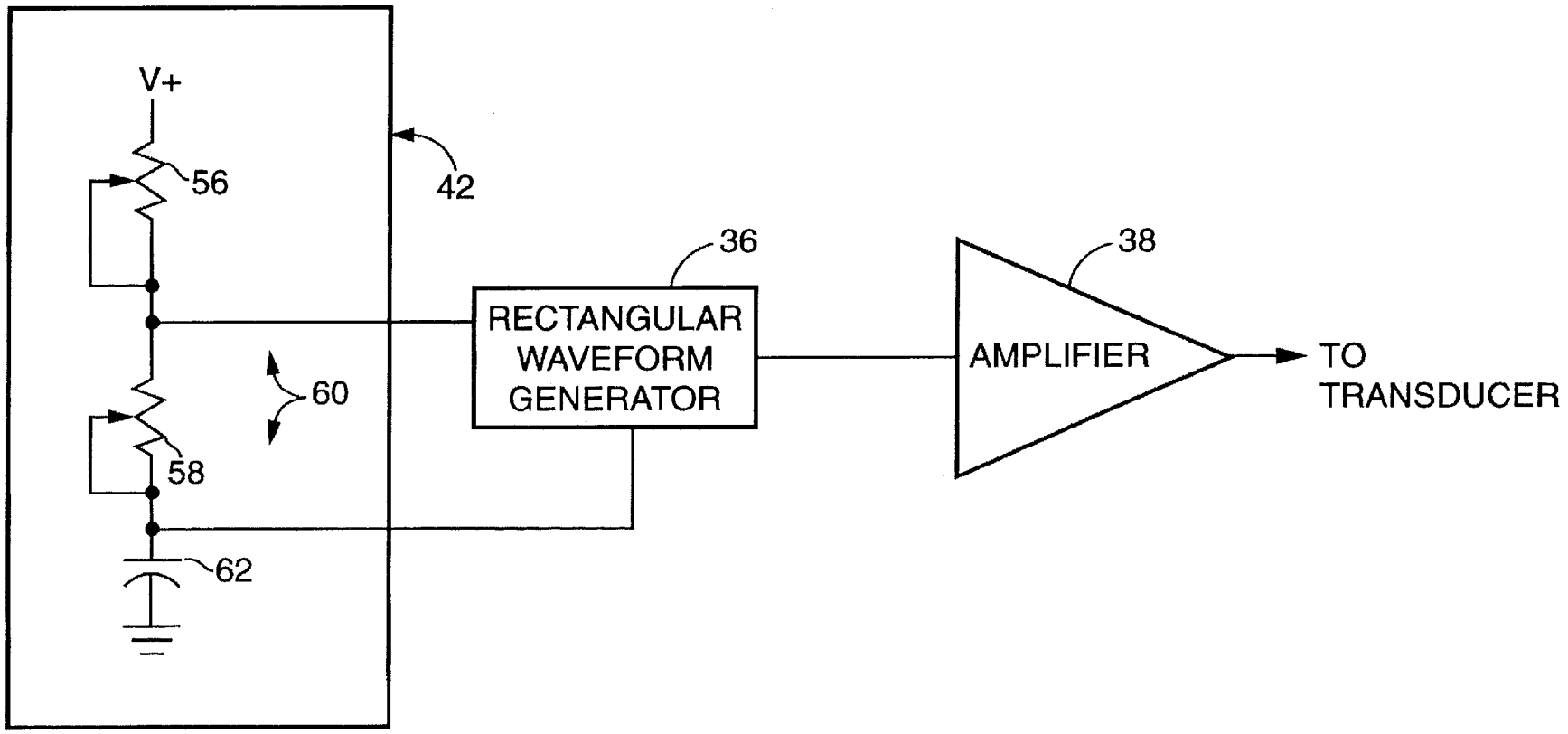
FIGS. 26 and 27 are block diagrams representing suitable waveform generators and harmonic content controllers for FIG. 1 that generate rectangular and triangular waveforms, respectively.

By way of example, as shown in FIG. 26 wherein the periodic non-sinusoidal waveform generator 36 comprises a rectangular waveform generator, the harmonic content of the waveform is varied by adjusting the resistance settings of one or more variable resistors 56, 58 (potentiometers) in the RC circuit 60. As can be appreciated, one type of waveform generator that is controllable to generate a rectangular wave of an appropriate frequency and duty cycle according to the values of resistors and a capacitor 62 comprises an astable multivibrator.

Figure 27:
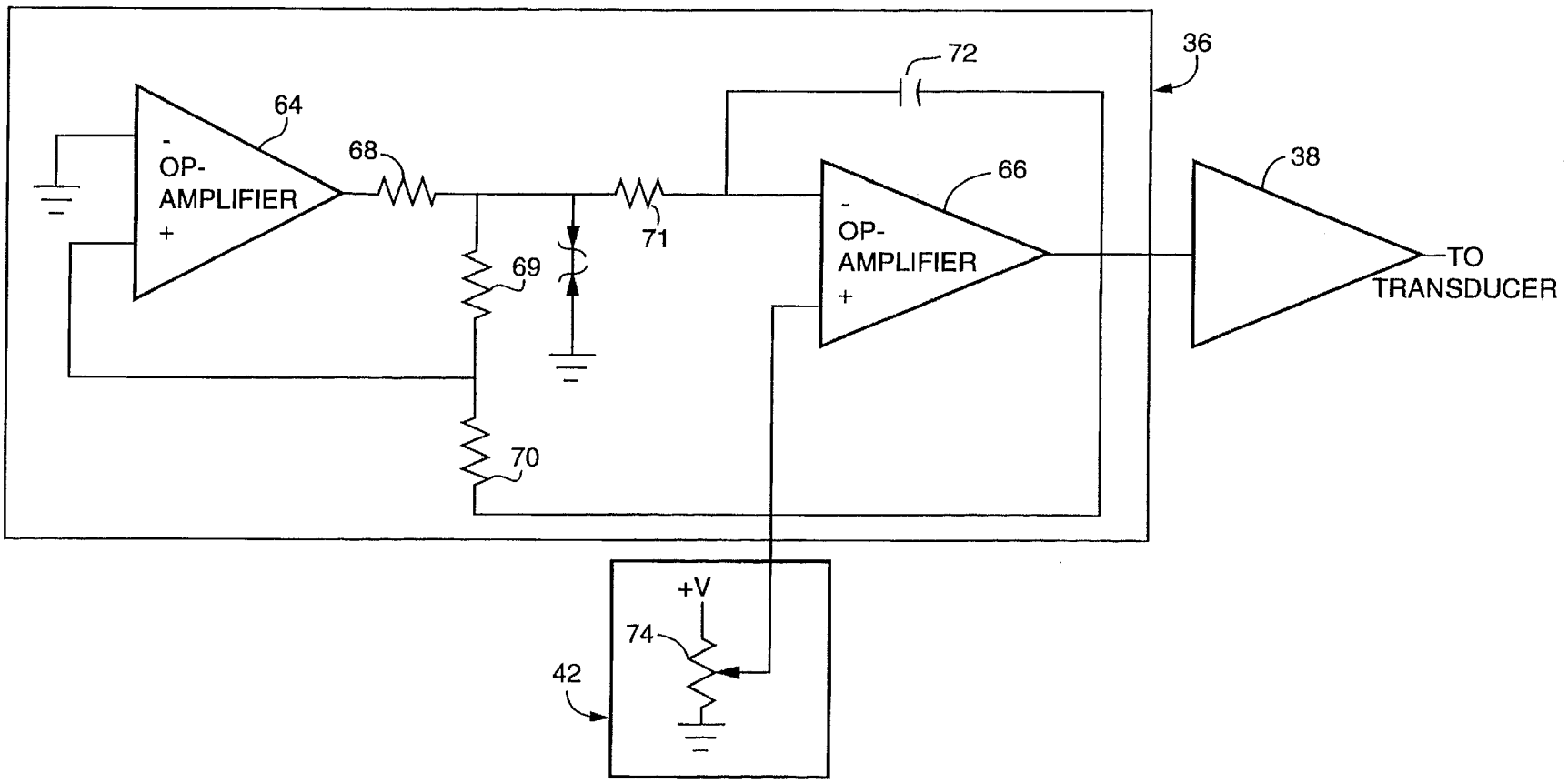

Alternatively, as shown in FIG. 27, the periodic non-sinusoidal waveform generator 36 may comprise a triangular waveform generator. With this particular circuit, operational amplifiers 64 and 66 are employed to generate the triangular waveform. Fixed resistors 68–71 and capacitor 72 are selected in a known manner. The duty cycle of the waveform is adjusted by adjusting the harmonic content controller 42, comprising a variable resistor 74 connected to vary the voltage on the non-inverting input of the operational amplifier 66.

Once adjusted, the harmonic content for the chosen waveform is established in the settings of the variable resistors 56, 58 (rectangular waveform generator) or in the setting of the variable resistor 74 (triangular waveform generator). In general, if a voltage controlled oscillator (not shown) serves as the waveform generator, an input voltage, which may originate from any suitable source, is provided to vary the harmonic content.

Regardless of how the harmonic content of the waveform is adjusted, the adjustment takes place in conjunction with an analysis of a resultant printed image and/or by viewing the actual drop formations, (for example by employing a microscope and a strobe light). According to the invention, the harmonic content is varied until the desired satellite condition and resultant desirable image formation are regularly achieved.

By way of example, to select and adjust a suitable non-sinusoidal waveform for a given ink and nozzle combination when a conventional sinusoidal waveform is unacceptable, a rectangular waveform having a twenty-five percent duty cycle is initially employed as the driving waveform. The quality of the printed image or the actual formation of the drops is then analyzed for various driving amplitudes of the rectangular waveform. If the results obtained at the twenty-five percent duty cycle are less than ideal, the rectangular waveform may be effectively inverted to have a seventy-five percent duty cycle in order to determine if the drop formation or the resultant image quality is consequently enhanced as analyzed at various driving amplitudes.

If improvements to the image quality beyond those provided by the rectangular waveform are still likely or necessary, a triangular waveform having a twenty-five percent duty cycle may be subsequently selected and utilized as the driving waveform, and the results again analyzed at various driving amplitudes. As with the rectangular waveform, this triangular waveform may be inverted to have a seventy-five percent duty cycle in order to determine the effect on the quality of the printed image. Other waveforms may be selectively applied to the transducer in a similar manner, although typically either a rectangular or triangular waveform provides acceptable results.

Finally, once an appropriate waveform is established, the harmonics, or symmetries, of the waveform may be adjusted as desired in order to fine-tune the drop formation as evidenced by the quality of the printed image. As described above, a change in the harmonic content of a waveform alters the duty cycle thereof While a twenty-five or a seventy-five percent duty cycle typically provides the desired results, examples of duty cycles ranging from ten to thirty-five (or ninety to sixty-five) percent have produced preferable results with other ink and nozzle combinations. If a range of duty cycles is determined to provide acceptable image formation, the duty cycle may be set substantially in the middle of the range.

Figure 28:
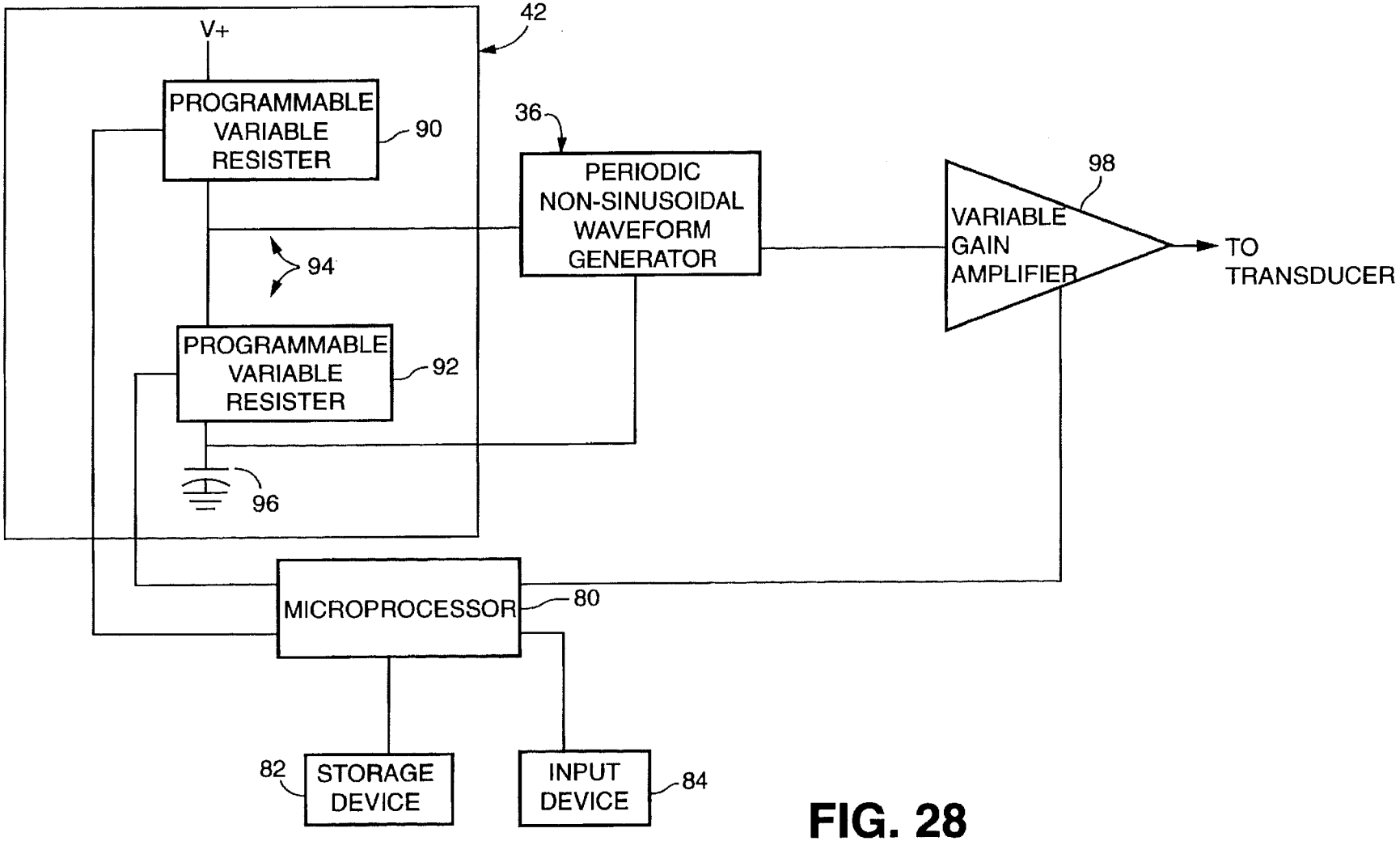
FIG. 28 is a block diagram representing a programmable rectangular waveform generator and harmonic content controller for FIG. 1.

Since formulations of inks may vary over time, and since one type of printer may be used with several different types of inks and/or nozzles, an alternate embodiment of the invention shown in FIG. 28 includes means for electrically varying the waveform. This enables the driving waveform to be controlled by commands from a printer controller, a personal computer, or the like.

In FIG. 28, a microprocessor 80 is connected to a storage device 82 which may be a RAM, ROM, a computer disk or the like. The storage device 82 has previously stored therein the optimal waveform parameters for a number of inks and/or nozzles. Based on the type of ink and/or nozzle, which are input (along with any other variables that are deemed significant) as values into the microprocessor 80 via input means 84, the microprocessor 80 accesses the storage device 82 to obtain the corresponding optimal waveform parameters to adjust the waveform generator 36. For example, the microprocessor 80 may be arranged to reference a database in the storage device 82 to obtain the optimal waveform duty cycle, amplitude and frequency for a given ink and nozzle combination. Of course, the microprocessor 80 may alternatively receive waveform information directly from the input device 84.

The microprocessor 80 may be present in an external device such as a personal computer, however it can be appreciated that many ink jet printing systems already are equipped with a printer controller for controlling other aspects of the printing operation. Thus, such a printer controller can be modified to perform the functions of the microprocessor 80 described herein.

As shown in FIG. 28, the programmable variable resistors 90, 92 are electrically adjustable by the computer signals, such as in a programmable resistor network. These resistors comprise an RC circuit 94 that controls the operation of the astable multivibrator as in the previously described circuit of FIG. 26. Alternatively, a latched digital-to-analog voltage converter (not shown) coupled to a voltage controlled resistor may act as a programmable resistor.

Output signals from the microprocessor 80 set the values of the resistors 90, 92, thus determining the corresponding duty cycle and/or frequency. Similar output signals are also used to set the gain of a variable gain amplifier 98. Once the waveform characteristics are set, the system may be arranged such that the microprocessor-based device can subsequently be disconnected from the printing apparatus, such as by unplugging a portable personal computer. In this manner, a consistent and rapid change to the waveform may be accomplished as inks or nozzles are varied.

Moreover, it is feasible to remotely set the parameters of the driving waveform to match given ink and nozzle combinations. For example, the parameters may be set via telephone, modem, transmission cable, or other transmission means from a central or remote location. Alternatively, each time a new ink is developed, the ink may be shipped with a set of waveform parameters stored on a floppy disk or the like that may be used by the customer to tailor the system to the new type of ink. Indeed, other methods of supplying information to adjust the duty cycle or harmonics of the waveform are feasible. For example, the input means 84 may comprise DIP switches operatively connected to the microprocessor 80 such that the settings thereof corresponding to selected parameters for known ink and/or nozzle configurations. Of course, DIP switches may alternatively be arranged to directly vary the resistance settings of resistors and thus adjust the waveform duty cycle or harmonics without a microprocessor.

While FIG. 28 describes a programmable rectangular waveform with a corresponding rectangular waveform generator, it can be readily appreciated that other waveforms may be set by programmably controlling a similar waveform generator and/or harmonic content controller. For example, the harmonic content of a triangular waveform may be electrically controlled by utilizing a programmable resistor as the variable resistor 74 in FIG. 27, and similarly connecting it for adjustment by the output of a microprocessor. Moreover, a microprocessor may further be employed to select the type of periodic non-sinusoidal driving waveform from a waveform generator capable of outputting multiple-types of waveforms (not shown).

Finally, although not necessary to the invention, by utilizing a camera in a computerized vision system to compare the actual drop formation or to analyze printed images against changes to the duty cycle and other parameters, it is further feasible to automate the adjustment process in a closed-loop control system. This may be performed during installation or in real-time during actual printing operations.

As can be seen from the foregoing detailed description, there is provided an apparatus and method for producing drops of ink in a continuous ink jet printing system that achieves desirable satellite formation thereby resulting in desirable printing conditions. The desired satellite formation is achieved for an increased variety of inks and nozzle types, including hot-melt inks, and with a reduced amount of power consumption. The desired satellite conditions are achieved with simplified electrical driving circuitry that provides improved cost savings and reliability, and without increasing the amplitude of the driving signal above customary excitation levels.

What is claimed is:

1. In a continuous ink jet printer having a pressurized supply of ink in fluid communication with a discharge nozzle, an apparatus for perturbing the ink into primary drops and satellite drops providing a stream of ink drops having a quantity of fast satellites associated therewith, comprising, a transducer coupled to the discharge nozzle for imparting mechanical vibration thereto, signal generating means for driving the transducer with a periodic non-sinusoidal waveform including a harmonic content, and an adjustable harmonic controller for adjusting the harmonic content of the periodic non-sinusoidal waveform thereby adjusting the quantity and direction of motion of the satellite drops.

2. The apparatus of claim 1 wherein the harmonic content of the periodic non-sinusoidal waveform comprises a series of at least four harmonics and wherein the harmonic controller includes means for adjusting the harmonic content of the waveform such that the fourth harmonic of the series, and multiples thereof of said waveform are zero.

3. The apparatus of claim 1 wherein the harmonic content of the periodic non-sinusoidal waveform comprises a series of at least four harmonics and wherein the harmonic controller includes means for adjusting the harmonic content of the waveform such that the fourth harmonic of the series and multiples thereof of said waveform are near zero.

4. The apparatus of claim 1 wherein the periodic non-sinusoidal waveform is a rectangular waveform and wherein the signal generating means includes a rectangular waveform generator.

5. The apparatus of claim 4 wherein the rectangular waveform generator comprises an astable multivibrator, and the means for controlling the harmonic content includes a variable resistor.

6. The apparatus of claim 1 wherein the periodic non-sinusoidal waveform is a triangular waveform and wherein the signal generating means includes a triangular waveform generator.

7. The apparatus of claim 6 wherein the means for controlling the harmonic content includes a variable resistor.

8. The apparatus of claim 1 wherein the waveform has an amplitude and further comprising means for adjusting the amplitude of the waveform.

9. The apparatus of claim 1 wherein the waveform has a frequency and further comprising means for adjusting the frequency of the waveform.

10. The apparatus of claim 1 wherein the ink comprises a hot-melt ink that is in a solid phase at ambient room temperatures and at a liquid phase at temperatures above ambient room temperatures, and further comprising a heater coupled to the supply of ink for liquefying the ink.

11. The apparatus of claim 1 further comprising a microprocessor operatively connected to the harmonic controller, wherein the periodic non-sinusoidal waveform has a duty cycle and wherein the microprocessor provides electrical signals to vary the duty cycle of the periodic non-sinusoidal waveform.

12. The apparatus of claim 11 further comprising a data storage device operatively connected to the microprocessor, wherein the microprocessor references the data storage device to provide electrical signals to vary the duty cycle of the periodic non-sinusoidal waveform.

13. In a continuous ink jet printing system, a method of producing a stream of drops having a desired number of fast satellite drops, comprising the steps of:

pressurizing a fluid for continuous flow to a nozzle;

generating a periodic non-sinusoidal waveform at a fixed frequency, the periodic non-sinusoidal waveform including a harmonic content;

applying the waveform to a transducer coupled to the nozzle such that the continuous flow is perturbed and discharged from the nozzle as primary drops and satellite drops associated therewith; and adjusting the harmonic content of the waveform to obtain the desired number of fast satellite drops in the stream of drops suitable for desired image formation.

14. The method of claim 13 wherein the waveform has an amplitude and further comprising the step of adjusting the amplitude of the waveform.

15. The method of claim 13 wherein the waveform has a frequency and further comprising the step of varying the frequency of the waveform.

16. The method of claim 13 wherein the step of adjusting the harmonic content includes the step of varying a resistance of a variable resistor.

17. The method of claim 13 wherein the desired number of fast satellite drops is a maximum of three.

18. The method of claim 17 further comprising the step of inspecting the drop formation to determine when no more than three fast satellites are present in the ink stream.

19. The method of claim 13 wherein the step of generating the periodic non-sinusoidal waveform comprises the step of generating a rectangular waveform.

20. The method of claim 19 wherein the step of periodic non-sinusoidal waveform has a duty cycle and wherein the step of adjusting the harmonic content of the rectangular waveform comprises the step of setting the duty cycle between sixty and ninety percent high.

21. The method of claim 19 wherein the periodic non-sinusoidal waveform has a duty cycle and wherein the step of adjusting the harmonic content of the rectangular waveform comprises the step of setting the duty cycle between forty and ten percent high.

22. The method of claim 13 where the step of generating the periodic non-sinusoidal waveform comprises the step of generating a triangular waveform.

23. The method of claim 22 wherein the periodic non-sinusoidal waveform has a duty cycle and wherein the step of adjusting the harmonic content of the triangular waveform comprises the step of setting the duty cycle between sixty and ninety percent high.

24. The method of claim 22 wherein the periodic non-sinusoidal waveform has a duty cycle and wherein the step of adjusting the harmonic content of the triangular waveform comprises the step of setting the duty cycle between forty and ten percent high.

25. The method of claim 13 wherein the ink is a hot-melt ink that is in a solid phase at ambient room temperatures and in a liquid phase at increased temperatures, and further comprising the step of heating the ink to convert it to its liquid phase.

26. The method of claim 13 wherein the harmonic content of the periodic non-sinusoidal waveform comprises a series of at least four harmonics and wherein the harmonic content of the periodic non-sinusoidal waveform is adjusted such that the fourth harmonic of the series and multiples thereof of said waveform are zero.

27. The method of claim 13 wherein the harmonic content of the periodic non-sinusoidal waveform comprises a series of at least four harmonics and wherein the harmonic content of the periodic non-sinusoidal waveform is adjusted such that the fourth harmonic of the series and multiples thereof of said waveform are near zero.

28. In a continuous ink jet printer having a pressurized supply of ink in fluid communication with a discharge nozzle, an apparatus for perturbing the ink into primary drops and satellite drops to provide a stream of ink drops having a quantity of fast satellites associated therewith, comprising, a transducer coupled to the discharge nozzle for imparting mechanical vibration thereto, signal generating means for driving the transducer with a periodic non-sinusoidal waveform, and an adjustable harmonic controller for driving the transducer with the periodic non-sinusoidal waveform having characteristics that generate a maximum of three fast satellite drops in the ink stream.

29. The apparatus of claim 28 wherein the periodic non-sinusoidal waveform includes a harmonic content comprising a series of at least four harmonics and wherein the controller includes a harmonic content controller having means for adjusting the periodic non-sinusoidal waveform such that the fourth harmonic of the series and multiples thereof of said waveform are zero.

30. The apparatus of claim 28 wherein the periodic non-sinusoidal waveform includes a harmonic content comprising a series of at least four harmonics and wherein the controller includes a harmonic content controller having means for adjusting the periodic non-sinusoidal waveform such that the fourth harmonic of the series and and multiples thereof of said waveform are near zero.

31. The apparatus of claim 28 wherein the periodic non-sinusoidal waveform is a rectangular waveform and wherein the signal generating means includes a rectangular waveform generator.

32. The apparatus of claim 31 wherein the rectangular waveform generator comprises an astable multivibrator, and the controller includes a variable resistor for controlling the characteristics of the periodic non-sinusoidal waveform.

33. The apparatus of claim 28 wherein the periodic non-sinusoidal waveform is a triangular waveform and wherein the signal generating means includes a triangular waveform generator.

34. The apparatus of claim 33 wherein the controller includes a variable resistor.

* * * * *